US010836565B2

(12) United States Patent
Ge et al.

(10) Patent No.: US 10,836,565 B2
(45) Date of Patent: Nov. 17, 2020

(54) PACKAGING BOX FOR VIRTUAL REALITY DEVICE

(71) Applicants: BEIJING BOE OPTOELECTRONICS TECHNOLOGY CO., LTD., Beijing (CN); BOE TECHNOLOGY GROUP CO., LTD., Beijing (CN)

(72) Inventors: Zheng Ge, Beijing (CN); Wenhong Tian, Beijing (CN); Haoran Jing, Beijing (CN)

(73) Assignees: BEIJING BOE OPTOELECTRONICS TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/410,462

(22) Filed: May 13, 2019

(65) Prior Publication Data

US 2020/0122917 A1 Apr. 23, 2020

(30) Foreign Application Priority Data

Oct. 19, 2018 (CN) ..... 2018 2 1701481 U

(51) Int. Cl.
*B65D 85/18* (2006.01)
*B65D 81/133* (2006.01)
*B65D 63/10* (2006.01)

(52) U.S. Cl.
CPC ..... *B65D 85/18* (2013.01); *B65D 63/109* (2013.01); *B65D 81/133* (2013.01)

(58) Field of Classification Search
CPC ... B65D 5/02; B65D 5/42; B65D 5/50; B65D 43/02; B65D 63/10; B65D 63/109; B65D 81/02; B65D 81/05; B65D 81/36; B65D 81/133; B65D 85/00; B65D 85/18; B65D 85/30
USPC ..... 206/45.2–45.26, 45.28–45.3, 305, 320, 206/521, 523
See application file for complete search history.

(56) References Cited

U.S. PATENT DOCUMENTS 1,499,994 A * 7/1924 Marx ..... B65D 85/66 206/738
3,040,879 A * 6/1962 Planitzer ..... B65D 81/113 206/523
3,273,779 A * 9/1966 Mykleby ..... B65D 81/1075 206/523

(Continued)

*Primary Examiner* — Bryon P Gehman
(74) *Attorney, Agent, or Firm* — Kinney & Lange, P.A.

(57) ABSTRACT

The present application provide a packaging box for a Virtual Reality (VR) device. The packaging box includes: a first box body having a top cover and a first sidewall; and a second box body having a bottom cover and a second sidewall, wherein the first sidewall has a second edge opposite to the first edge thereof, the second sidewall has a second edge opposite to the first edge thereof, and the second edge of the first sidewall and the second edge of the second sidewall are adapted to fit with each other so as to form the packaging space for the VR device, and wherein the first surface of the first box body has a fixing structure for fixing the wearable component provided thereon, and the first surface of the second box body has an accommodating structure for accommodating the device body provided thereon.

8 Claims, 3 Drawing Sheets

(56) References Cited

U.S. PATENT DOCUMENTS

| | | | | | |
|---|---|---|---|---|---|
| 4,241,829 | A * | 12/1980 | Hardy | B65D 5/563 | 206/523 |
| 6,789,675 | B2 * | 9/2004 | Abe | B65D 77/02 | 206/521 |
| 9,857,597 | B2 * | 1/2018 | Palanisamy | B65D 5/5045 | |
| 10,139,637 | B2 * | 11/2018 | Costa | G02B 27/028 | |
| 2004/0262187 | A1 * | 12/2004 | Schauer | B65D 25/10 | 206/521 |
| 2018/0186543 | A1 * | 7/2018 | Shah | B65D 81/022 | |

* cited by examiner

PACKAGING BOX FOR VIRTUAL REALITY DEVICE

CROSS-REFERENCE TO RELATED APPLICATION

The present application claims priority to the Chinese Patent Application 201821701481.9, filed on Oct. 19, 2018, which is incorporated herein by reference in its entirety.

TECHNICAL FIELD

The present disclosure relates to the field of virtual reality, and more particularly, to a packaging box for a virtual reality device.

BACKGROUND

With the development and popularity of Virtual Reality (VR) technology, more and more VR devices are coming into people's lives. After being assembled, VR devices need to be transported over long distances to reach consumers' markets in various places. Currently, there are three types of common wearable components for a VR device, discussed below.

A first type of wearable component is a strap-on wearable component, which comprises three webbings, to fix a display of the VR device to a user's head. Such a VR device has a relatively simple packaging box structure, and only a device body thereof needs to be fixed.

A second type of wearable component is a head-worn wearable component, i.e., a head ring which may be adjusted according to a user's head circumference, to hang a display of the VR device at a front end thereof. A packaging box of such a VR device needs to be provided with a cylindrical structure at a bottom thereof to match the head ring, so as to prevent the head ring from moving left and right.

A third type of wearable component is a C-type wearable component, which has a certain elasticity and flexibility to fix a display of the VR device to a user's head. Due to the certain elasticity and flexibility of the C-type wearable component, the current packaging box cannot effectively fix the entire VR device with the C-type headband well, which is prone to shaking, shifting, etc.

SUMMARY

According to a first aspect of the present disclosure, there is provided a packaging box for a Virtual Reality (VR) device. The VR device comprises a device body and a wearable component. The packaging box for the VR device comprises: a first box body having a top cover and a first sidewall, wherein a first edge of the first sidewall is in contact with an edge of the top cover to define a first space on a first surface of the top cover by surrounding the first surface of the top cover; and a second box body having a bottom cover and a second sidewall, wherein a first edge of the second sidewall is in contact with an edge of the bottom cover to define a second space on a first surface of the bottom cover by surrounding the first surface of the bottom cover, wherein the first sidewall has a second edge opposite to the first edge thereof, the second sidewall has a second edge opposite to the first edge thereof, and the second edge of the first sidewall and the second edge of the second sidewall are adapted to fit with each other so as to form the packaging space for the VR device, and wherein the first surface of the first box body has a fixing structure for fixing the wearable component provided thereon, and the first surface of the second box body has an accommodating structure for accommodating the device body provided thereon.

In some embodiments, a portion of the second edge of the first sidewall is pivotably connected to a portion of the second edge of the second sidewall.

In some embodiments, the accommodating structure comprises a device body accommodating groove and an accessory accommodating groove connected to the device body accommodating groove, the device body accommodating groove is disposed at a position away from a position where the pivoting connection is located, and the accessory accommodating groove is disposed at a position close to the position where the pivoting connection is located.

In some embodiments, the fixing structure comprises a groove matching a width dimension of the wearable component, and configured to fix a top portion of the wearable component in a state the first box body and the second box body form the packaging space.

In some embodiments, the fixing structure further comprises a device body fixing part disposed at a position away from a position where the pivoting connection is located, and configured to be in contact with the device body in a state the first box body and the second box body form the packaging space so that the device body is fixed with respect to the second box body.

In some embodiments, the accessory accommodating groove comprises at least one of a webbing accommodating groove, a data line accommodating groove or an adapter accommodating groove which are juxtaposed.

In some embodiments, the accommodating structure further comprises an accessory fixing part which protrudes from a sidewall of the accessory accommodating groove.

In some embodiments, a positioning ribbon is further disposed between the first box body and the second box body, and is configured to maintain a fixed angle of rotation around the pivoting connection between the first box body and the second box body.

In some embodiments, the fixing structure and the accommodating structure comprise an elastic material.

In some embodiments, the elastic material is an ethylene-vinyl acetate copolymer.

The present summary is provided only by way of example, and not limitation. Other aspects of the present disclosure will be appreciated in view of the entirety of the present disclosure, including the entire text, claims, and accompanying figures.

Figure 1:
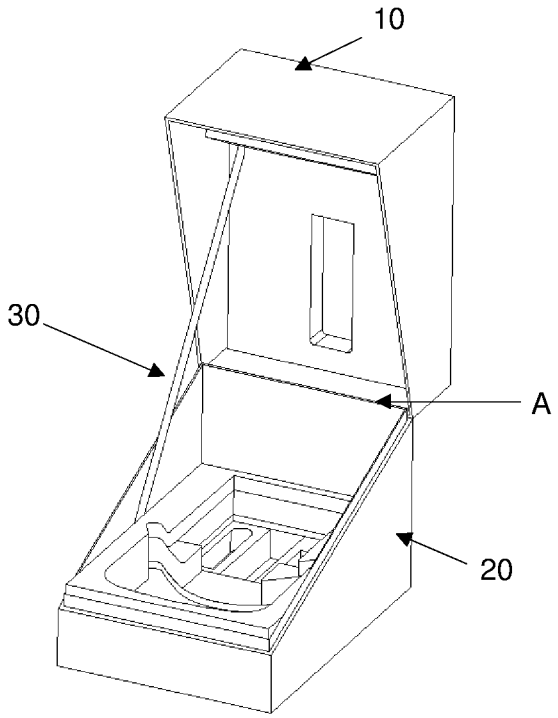
FIG. 1 is a structural diagram of a packaging box for a VR device according to an embodiment of the present disclosure.
Figure 2:
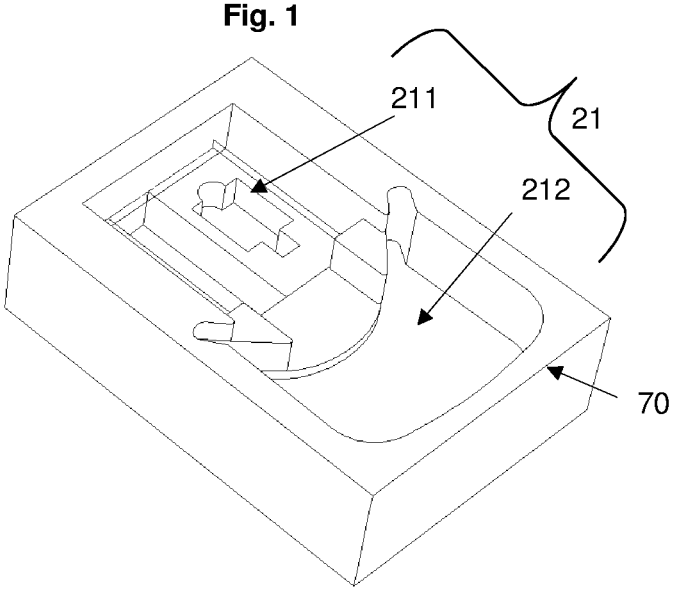
FIG. 2 is a diagram of an accommodating structure of a second box body of a packaging box for a VR device according to an embodiment of the present disclosure.

While the above-identified figures set forth one or more embodiments of the present disclosure, other embodiments are also contemplated, as noted in the discussion. In all cases, this disclosure presents the invention by way of representation and not limitation. It should be understood that numerous other modifications and embodiments can be devised by those skilled in the art, which fall within the scope and spirit of the principles of the invention. The figures may not be drawn to scale, and applications and embodiments of the present invention may include features and components not specifically shown in the drawings.

DETAILED DESCRIPTION

The following are non-exclusive descriptions of possible embodiments of the present invention. The technical solutions in the embodiments of the present disclosure will be clearly and completely described below with reference to the accompanying drawings in the embodiments of the present disclosure. It is obvious that the embodiments described are a part of the embodiments of the present disclosure, instead of all the embodiments. All other embodiments obtained by those of ordinary skill in the art based on the embodiments of the present disclosure without any creative work fall within the protection scope of the present disclosure.

In a packaging box for a VR device in the related art, blister materials such as polyethylene terephthalate (PET) etc. are often used as internal materials, and the entire device is fixed only by a matching structure in one of two box bodies. The packaging box used in the related art cannot tightly fix a VR device with a C-type wearable component, and cannot effectively prevent the displacement of the VR device due to inversion or dropping conditions of the packaging box.

A packaging box for a VR device according to the present disclosure will be described in detail below using several specific embodiments.

As shown in FIG. 1, illustrated is a structural diagram of a packaging box for a VR device according to an embodiment of the present disclosure.

As shown in FIG. 1, the packaging box for the VR device comprises a first box body 10 and a second box body 20.

The first box body 10 has a top cover and a first sidewall. A first edge of the first sidewall is in contact with an edge of the top cover to define a first space on a first surface of the top cover by surrounding the first surface of the top cover.

The second box body 20 has a bottom cover and a second sidewall. A first edge of the second sidewall is in contact with an edge of the bottom cover to define a second space on a first surface of the bottom cover by surrounding the first surface of the bottom cover.

The first sidewall has a second edge opposite to the first edge thereof. The second sidewall has a second edge opposite to the first edge thereof. The second edge of the first sidewall and the second edge of the second sidewall are adapted to fit with each other so as to form the packaging space for accommodating the VR device.

In an embodiment of the present disclosure, the VR device comprises a device body and a wearable component. The first surface of the first box body 10 has a fixing structure 60 for fixing the wearable component provided thereon. The first surface of the second box body 20 has an accommodating structure 70 for accommodating the device body provided thereon.

In some embodiments of the present disclosure, the wearable component and the device body in the VR device are placed in the packaging box for the VR device in a state the wearable component and the device body are assembled together.

In an embodiment of the present disclosure, a portion of the second edge of the first sidewall is pivotably connected to a portion of the second edge of the second sidewall to form a pivoting connection, for example, as shown by a connection line A in FIG. 1.

In an embodiment of the present disclosure, the accommodating structure 70 has an accommodating groove 21 formed thereon. The accommodating groove 21 comprises a device body accommodating groove 212 and an accessory accommodating groove 211 connected to the device body accommodating groove 212. The device body accommodating groove 212 is disposed at a position away from a position where the pivoting connection (i.e., the connection line A) is located, and the accessory accommodating groove 211 is disposed at a position close to the position where the pivoting connection is located.

Figure 3:
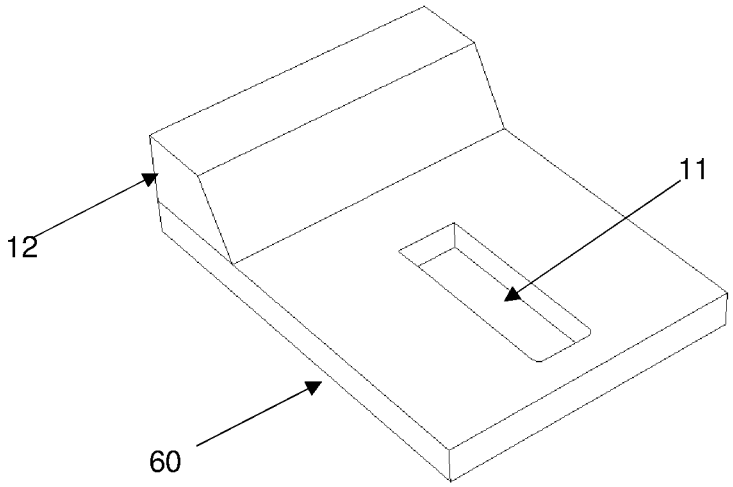
FIG. 3 is a diagram of a fixing structure of a first box body of a packaging box for a VR device according to an embodiment of the present disclosure.

In an embodiment of the present disclosure, as shown in FIG. 3, the fixing structure 60 has a groove 11 formed thereon. The groove 11 matches a width dimension of the wearable component to be accommodated. In a state the first box body 10 and the second box body 20 form the packaging space, a top portion of the wearable component may be limited in the groove 11.

In an embodiment of the present disclosure, the groove 11 is used to prevent the wearable component from shaking without generating pressure on the wearable component, so as to avoid damage to the entire VR device.

Figure 5:
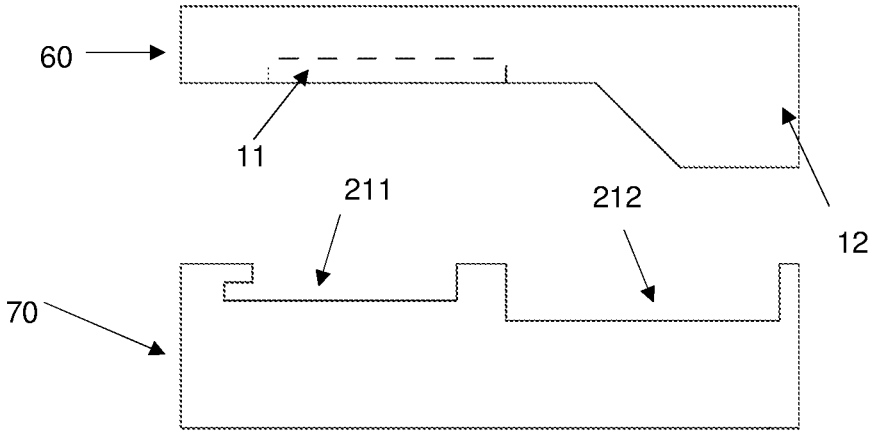
FIG. 5 is a diagram of a position of the accommodating structure relative to the fixing structure after the packaging box for the VR device is closed according to an embodiment of the present disclosure.

In an embodiment of the present disclosure, as shown in FIGS. 3 and 5, the first box body 10 further comprises a device body fixing part 12 disposed at a position away from a position where the first box body 10 is connected to the second box body 20 (for example, the connection line A in FIG. 1). In a state the first box body 10 and the second box body 20 form the packaging space, the device body fixing part 12 is in contact with the device body to be pressed against the device body.

In an embodiment of the present disclosure, in a state the first box body 10 and the second box body 20 form the packaging space, a lower surface of the device body fixing part 12 is in contact with the device body of the entire VR device, rather than be in direct contact with the second box body 20. Therefore, the device body fixing part 12 may be pressed against the device body to prevent the device body from moving inside the packaging box under action of external force.

In an embodiment of the present disclosure, the VR accessory may comprise: a webbing, a data line, and an adapter. Therefore, as shown in FIG. 1, the accessory accommodating groove 211 may comprise: a webbing accommodating groove, a data line accommodating groove, and an adapter accommodating groove which are juxtaposed.

Figure 4:
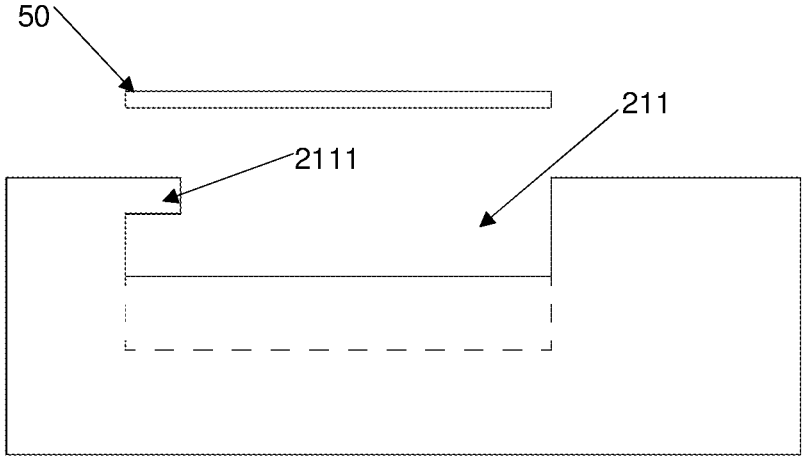
FIG. 4 is a partial structural diagram of a packaging box for a VR device according to an embodiment of the present disclosure.

In an embodiment of the present disclosure, as shown in FIG. 4, an instruction envelope 50 may further be packaged in the packaging box. A protruding accessory fixing part 2111 is provided on a sidewall of the accessory accommodating groove 211, to limit the instruction envelope when the instruction envelope covers the webbing accommodating groove, the data line accommodating groove and the adapter accommodating groove.

In an embodiment of the present disclosure, the instruction envelope 50 and the accessory fixing part 2111 are used in cooperation, which may prevent an accessory from coming off the accessory accommodating groove 211 due to shaking. Here, the accessory fixing part 2111 fixes the instruction envelope 50 to prevent the instruction envelope 50 from shifting up and down.

In an embodiment of the present disclosure, a positioning ribbon 30 is disposed between the first box body 10 and the second box body 20 to maintain a fixed angle of rotation around the pivoting connection (for example, the connection line A shown in FIG. 1) between the first box body 10 and the second box body 20.

In an embodiment of the present disclosure, the fixing structure 60 and the accommodating structure 70 comprise an elastic material.

In an embodiment of the present disclosure, the elastic material is an ethylene-vinyl acetate copolymer.

In an embodiment of the present disclosure, the fixing structure 60 and the accommodating structure 70 comprise an elastic material. When the device body fixing part 12 of the fixing structure 60 is pressed against the device body, the entire VR device may be further pressed under elastic action of the material, to prevent the entire VR device from shaking due to a matching gap.

According to the above embodiments of the present disclosure, the packaging box for the VR device according to the present disclosure may prevent the entire VR device from being subjected to impact force of the packaging box inside the packaging box when the packaging box is shaken or rotated, thereby improving the safety of the VR device.

It may be clearly understood by those skilled in the art that for the convenience and brevity of the description, a specific working process of the system, the apparatus and the unit described above may be known with reference to the corresponding process in the above method embodiment, and details thereof will not be described herein again.

The above description is only the preferred embodiments of the present disclosure, and is not intended to limit the present disclosure. Any modifications, equivalent substitutions and improvements etc. made within the spirit and principles of the present disclosure should be included in the protection scope of the present disclosure.

The above description is only the specific embodiments of the present disclosure, but the protection scope of the present disclosure is not limited thereto. Changes or substitutions which are easily reached by any person skilled in the art within the technical scope of the present disclosure should be covered within the protection scope of the present disclosure. Therefore, the protection scope of the present disclosure should be determined by the protection scope of the claims.

The invention claimed is:

1. A packaging box for a Virtual Reality (VR) device comprising a device body and a C-type wearable component, the packaging box for the VR device comprising:

a first box body having a top cover and a first sidewall, wherein a first edge of the first sidewall is in contact with an edge of the top cover to define a first space on a first surface of the top cover by surrounding the first surface of the top cover; and a second box body having a bottom cover and a second sidewall, wherein a first edge of the second sidewall is in contact with an edge of the bottom cover to define a second space on a first surface of the bottom cover by surrounding the first surface of the bottom cover, with a pivoting connection between the first box body and the second box body, wherein the first sidewall has a second edge opposite to the first edge thereof, the second sidewall has a second edge opposite to the first edge thereof, and the second edge of the first sidewall and the second edge of the second sidewall are adapted to fit with each other so as to form the packaging space for the VR device together, wherein the first surface of the top cover of the first box body has a fixing structure for fixing the C-type wearable component provided thereon, and the first surface of the bottom cover of the second box body has an accommodating structure for accommodating the device body provided thereon, wherein the accommodating structure comprises a device body accommodating groove and an accessory accommodating groove connected to the device body accommodating groove, the device body accommodating groove is disposed at a position away from a position where the pivoting connection is located, and the accessory accommodating groove is disposed at a position close to the position where the pivoting connection is located, and wherein the fixing structure comprises a groove with a width that is similar to a width secure of the C-type wearable component, and configured to a top portion of the C-type wearable component in a state where the first box body and the second box body form the packaging space.

2. The packaging box for the VR device according to claim 1, wherein a portion of the second edge of the first sidewall is pivotably connected to a portion of the second edge of the second sidewall to form the pivoting connection.

3. The packaging box for the VR device according to claim 1, wherein the fixing structure further comprises a device body fixing part disposed at a position away from a position where the pivoting connection is located, and configured to be in contact with the device body in a state the first box body and the second box body form the packaging space so that the device body is fixed with respect to the second box body.

4. The packaging box for the VR device according to claim 1, wherein a positioning ribbon is further disposed between the first box body and the second box body, and is configured to maintain a fixed angle of rotation around the pivoting connection between the first box body and the second box body.

5. The packaging box for the VR device according to claim 1, wherein the accessory accommodating groove comprises at least one of a webbing accommodating groove, a data line accommodating groove or an adapter accommodating groove which are juxtaposed.

6. The packaging box for the VR device according to claim 5, wherein the accommodating structure further comprises an accessory fixing part which protrudes from a sidewall of the accessory accommodating groove to secure an instruction envelope which covers the webbing accommodating groove, the date line accommodating groove, and the adapter accommodating groove.

7. The packaging box for the VR device according to claim 1, wherein the fixing structure and the accommodating structure comprise an elastic material.

8. The packaging box for the VR device according to claim 7, wherein the elastic material is an ethylene-vinyl acetate copolymer.

* * * * *